US007932448B1

(12) United States Patent
Bochar, Jr.

(10) Patent No.: US 7,932,448 B1
(45) Date of Patent: Apr. 26, 2011

(54) KEYWAY NECK JOINT FOR A STRINGED INSTRUMENT

(76) Inventor: Joseph Bochar, Jr., Canyon Country, CA (US)

( * ) Notice: Subject to any disclaimer, the term of this patent is extended or adjusted under 35 U.S.C. 154(b) by 0 days.

(21) Appl. No.: 12/587,249

(22) Filed: Oct. 5, 2009

Related U.S. Application Data

(60) Provisional application No. 61/103,885, filed on Oct. 8, 2008.

(51) Int. Cl.
*G10D 3/00* (2006.01)

(52) U.S. Cl. ..... 84/267; 84/291

(58) Field of Classification Search ..... 84/267, 84/291, 293
See application file for complete search history.

(56) References Cited

U.S. PATENT DOCUMENTS

| | | | | |
|---|---|---|---|---|
| 2,793,556 | A | 5/1957 | Maccaferri | |
| 3,196,730 | A | 7/1965 | Daniel | |
| 3,550,496 | A | 12/1970 | Fender | |
| 4,803,906 | A | 2/1989 | Fender | |
| 5,786,539 | A | 7/1998 | Steinberger | |
| 7,476,790 | B2 * | 1/2009 | Breedlove et al. | 84/293 |
| 2003/0066406 | A1 * | 4/2003 | Vartiainen | 84/291 |

OTHER PUBLICATIONS

George Gruhn, Rare Bird, Guitar Player Magazine, Sep. 1982, Guitar Player Magazine, Escondido, CA.

Barry Lipman, What Are the Pros and Cons of Bolt on Necks, Guitar Questions: The Novice's Guide to Guitar Repairs, 2002, p. 19, Cherry Lane Music Co., New York, NY.

* cited by examiner

*Primary Examiner* — Kimberly R Lockett
(74) *Attorney, Agent, or Firm* — John Alumit, Esq; Patel & Alumit, PC

(57) ABSTRACT

A method of improving the mechanical connection between a stringed instrument's neck and body by incorporating an interlocking jigsaw shaped mortise and tenon joint. The mortise is machined into the neck heel and the tenon is machined into the neck pocket of the instrument's body. The neck and body are press-fit together and secured with threaded fasteners.

11 Claims, 4 Drawing Sheets

KEYWAY NECK JOINT FOR A STRINGED INSTRUMENT

CROSS REFERENCE TO RELATED APPLICATIONS

This application claims the benefit of PPA Ser. No. 61/103,885, filed Oct. 8, 2008 by the present inventor, which is incorporated by reference.

STATEMENT REGARDING SPONSORED RESEARCH OR DEVELOPMENT

Not Applicable.

REFERENCE TO SEQUENCE LISTING

Not Applicable.

BACKGROUND

Field

This application relates to the construction of stringed instruments, specifically to an improved connection of the neck to the instrument's body.

BACKGROUND

Prior Art

Some stringed instruments, particularly electric guitars and basses, have been designed to allow the neck to be removed from the body during the life of the instrument. This allows for many advantages over more permanent set-neck designs with regards to manufacturing, repair, construction, and finishing. Assembly of the instrument requires less time due to the fact that since a bonding agent is not used, no time is lost waiting for glue to dry. Also, the fact that if there is catastrophic failure of either the neck or body, either can be easily replaced rather than rendering the instrument inoperable. It also makes regular maintenance easier, as the neck can be removed and worked on separately from the body.

A traditional removable neck design incorporates the use of a basic mortise and tenon joint, with the end of the neck opposite of the tuning pegs referred to as the heel, being the tenon. A cavity is milled into the guitar body, referred to as the neck pocket, that acts as the mortise. Inserting the neck heel into the neck pocket and using screws to secure the neck to the body has been a standard in the guitar industry for decades.

One of the main disadvantages to a traditional removable neck assembly is the loss of stability between the neck and body, commonly referred to as neck shifting in the pocket. Under normal operating conditions when all neck fasteners are tight the design performs as intended, but if the neck fasteners become loose or there is stress inflicted along the latitudinal or longitudinal axis' of the neck/body joint, tuning instability can occur and in some extreme cases a failure of the neck joint due to excessive stress on the wood and fasteners. Also, if the instrument's build tolerances where the neck attaches to the instrument's body are not to exacting specifications it can lead to an imperfect fit, which will greatly affect the sound quality and performance of the instrument.

Another disadvantage of a traditional removable neck assembly is the loss of energy when a string is plucked which decreases the sustain of a note or notes. The traditional removable neck design makes it inefficient as a conductor for string energy when compared to set-neck designs which are much more rigid, due to the set-neck construction method of a mortise and tenon or dovetail neck joint used in conjunction with a bonding agent. The more inflexible the joint the longer the strings will vibrate increasing sustain, resonance, and output.

SUMMARY

The present embodiment solves the stability problem of a traditional removable neck assembly by prohibiting latitudinal and longitudinal shifting/movement, due to the interlocking of a neck mortise and body tenon. The present embodiment also provides a more rigid connection and additional mating surface area between a neck and body resulting in improved sustain of the plucked string when played.

DRAWINGS

Figures

DRAWINGS

Reference Numerals

| | |
|---|---|
| 1 | neck |
| 2 | fretboard |
| 3 | fretwire |
| 4 | threaded insert |
| 5 | machine fastener |
| 6 | keyway neck mortise |
| 7 | body |
| 8 | neck pocket |
| 9 | neck pocket wall |
| 10 | keyway body tenon |
| 11 | pickup cavity |
| 12 | body mounting hole |
| 13 | neck mounting hole |
| 14 | bridge mounting hole |
| 15 | tailpiece mounting hole |

DETAILED DESCRIPTION

Figure 1:
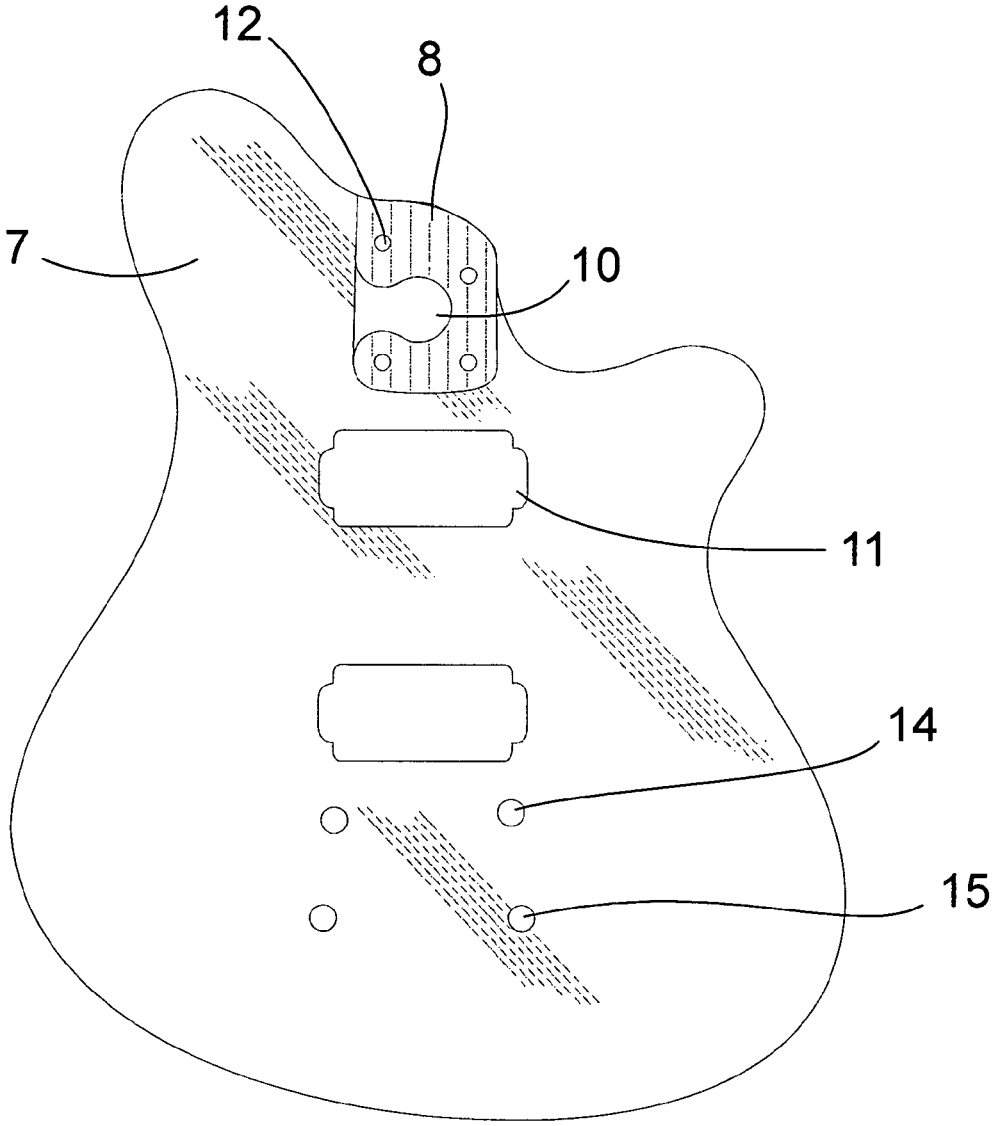
FIG. 1 shows the top plane view of the guitar body, neck pocket, keyway body tenon, and mounting holes.

FIG. 1 shows the top plane view of the guitar body 7, complete with bridge mounting holes 14, tailpiece mounting holes 15, pickup cavities 11, body mounting holes 12, and neck pocket 8. The specific shape of the keyway body tenon 10 is shown inside of the neck pocket 8 which is recessed into the guitar body 7, but stands proud of the plane of the neck pocket 8.

Figure 2:
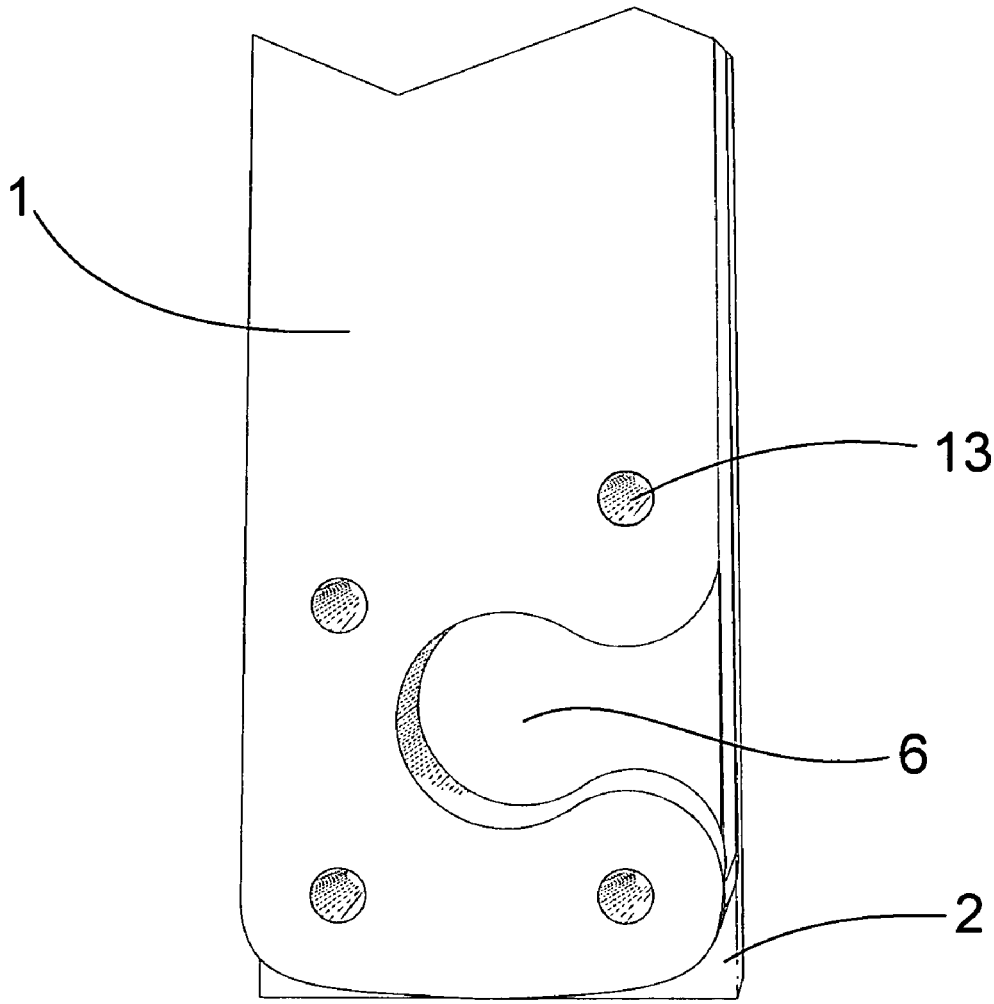
FIG. 2 shows a close-up of the neck heel and keyway neck mortise.

FIG. 2 shows a close-up of the lower portion of the neck 1, specifically the neck heel, where the keyway neck mortise 6 is located. Also shown for reference are the fretboard 2 and neck mounting holes 13. The keyway neck mortise 6 is milled to a predetermined depth into the neck.

Figure 3:
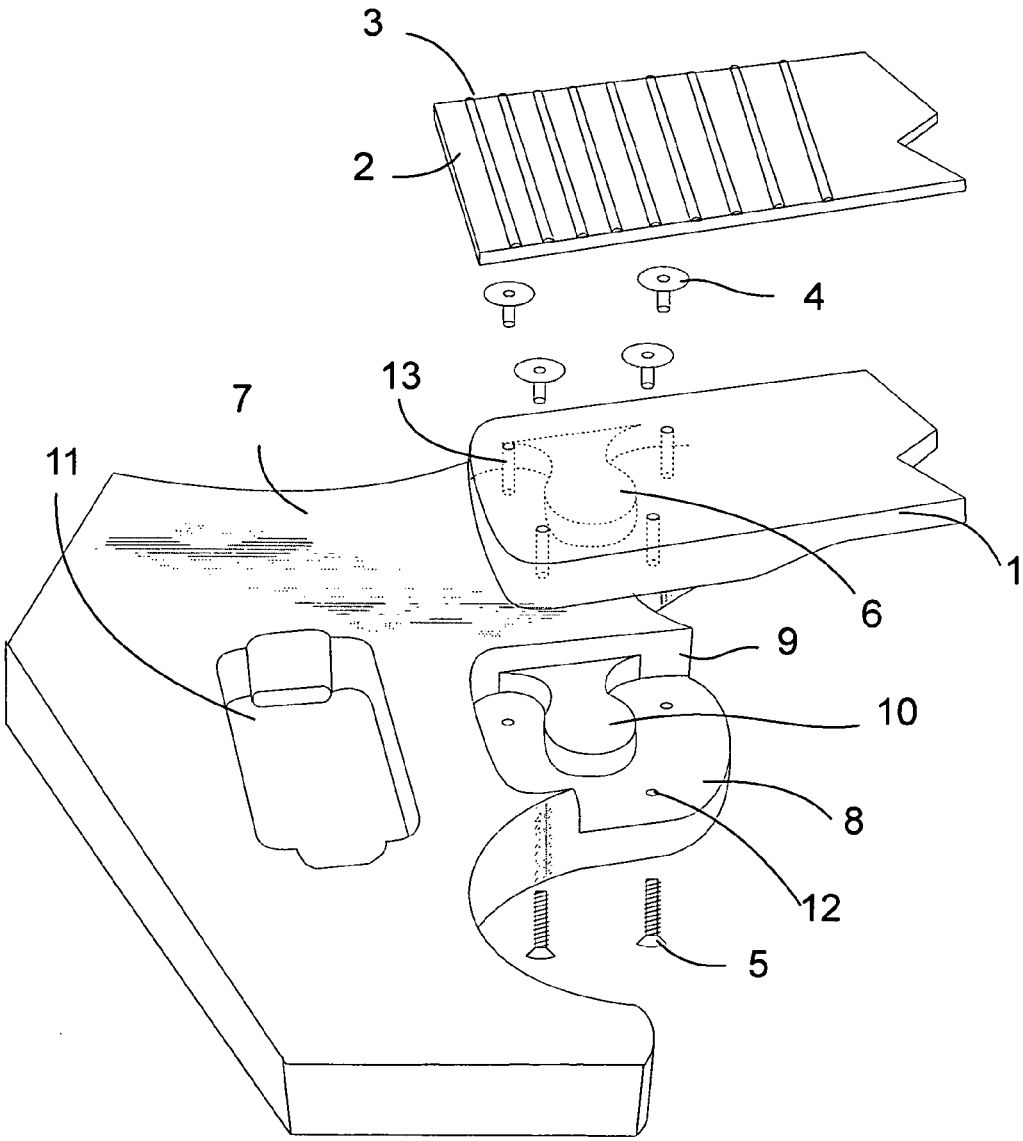
FIG. 3 shows an exploded view in perspective of the joint.

FIG. 3 is an exploded view of the relationship between all the components that incorporate the embodiment. The neck 1 is drilled and countersunk to accommodate the threaded inserts 4. The neck mounting holes 13 are then drilled through the neck 1 that will allow the machine screw fasteners 5 to couple the neck 1 to the body 7. The threaded inserts 4 are inserted and fixed to the neck 1. The fretboard 2 is then fixed to the neck 1 using a bonding agent, sandwiching the inserts between the neck 1 and fretboard 2. Fretwire 3 cut to specific lengths are then press-fit into slots milled into the fretboard 2, then filed and sanded to a uniform height. A milling machine then removes material from the heel of the neck to form the keyway neck mortise 6 (FIG. 2) to a depth that corresponds to the predetermined height of the keyway body tenon 10.

Figure 4:
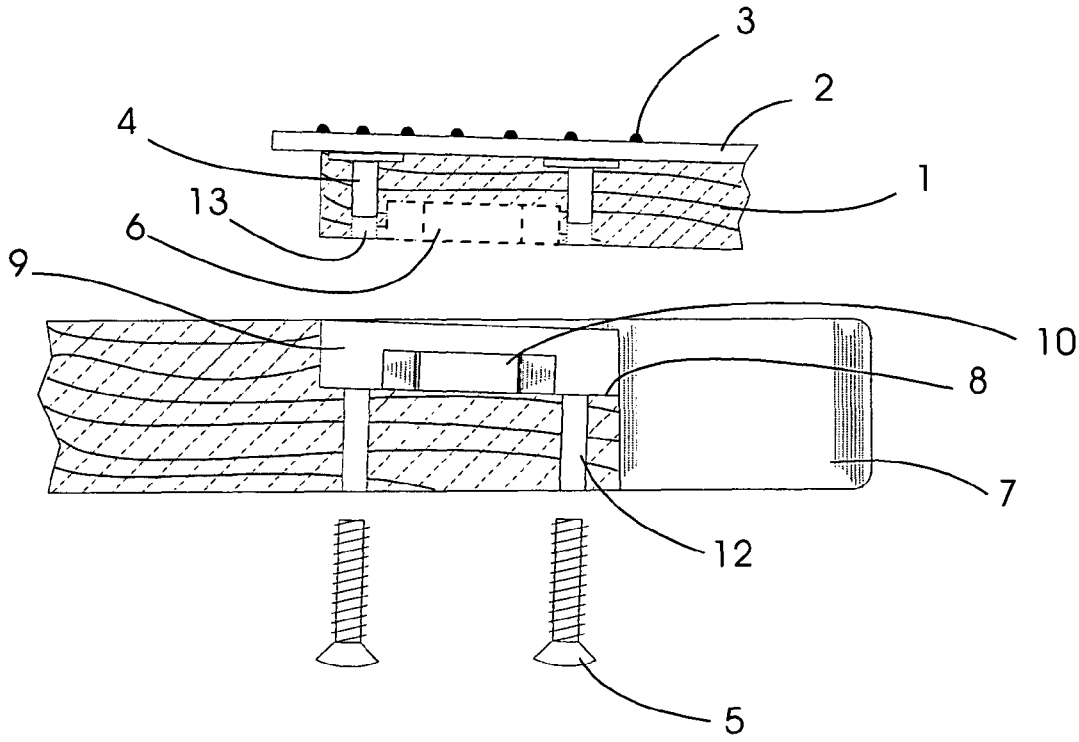
FIG. 4 shows a cross-sectional view of the joint.

FIG. 4 is a cross-view of the embodiment. The neck pocket 8 and keyway body tenon 10 are both milled to a predetermined angle with regards to the top plane of the body 7 (FIG. 4); specific angle is dependent on the type of application and hardware that is installed on the instrument. The outer shape of the neck pocket 8 and keyway body tenon 10 is milled into the body 7, then the height of the keyway body tenon 10 is milled to a predetermined depth into neck pocket 8.

After final finishing, the neck 1 and body 7 are to be assembled. After aligning the neck 1 and body 7, pressure is used to fit the two parts together forming an interlocking joint. Machine screw fasteners (5) are then inserted into the body mounting holes (12), through the neck mounting holes (13), and are engaged into the threaded inserts (4).

I claim:

1. A method for attaching a neck onto a body of a stringed instrument, comprising:

a jigsaw shaped mortise milled into the underside said neck at the heel;

a jigsaw shaped tenon milled into the neck pocket of said body of said stringed instrument adapted for insertion into the underside of said neck at the heel;

and a plurality of threaded inserts that accept a plurality of threaded fasteners that extend through said body via holes positioned in close proximity to the jigsaw shaped tenon and into said threaded inserts of said neck, securing said neck onto said body.

2. Attaching method according to claim 1, wherein said stringed instrument is a guitar.

3. Attaching method according to claim 2, wherein said stringed instrument is an electric guitar.

4. Attaching method according to claim 1, wherein said stringed instrument is a bass guitar.

5. Attaching method according to claim 4, wherein said stringed instrument is an electric bass guitar.

6. A method of claim 1, wherein a neck with a jigsaw shaped mortise milled into the heel of said neck is engaged into the neck pocket of a body with a jigsaw shaped tenon milled into said neck pocket of said body, and said neck is further secured by engaging threaded fasteners that extend through said body via holes and into said threaded inserts of said neck, securing said neck to said body.

7. A method of claim 1 wherein the jigsaw shaped mortise is described as a curved jigsaw puzzle shaped recess accepting of a corresponding jigsaw shaped tenon.

8. A method of claim 1 wherein the jigsaw shaped tenon is described as a curved jigsaw puzzle shaped protrusion milled to interlock with a corresponding jigsaw shaped mortise when assembled.

9. A method of claim 1 wherein the threaded inserts are sandwiched between a fretboard and the neck.

10. A method of claim 9 wherein the threaded inserts are metal.

11. A method of claim 1 wherein the threaded fasteners are metal screws.

* * * * *